US008142295B2

(12) United States Patent
Mesika

(10) Patent No.: US 8,142,295 B2
(45) Date of Patent: Mar. 27, 2012

(54) LEVITATING DISK

(76) Inventor: Yigal Mesika, Los Angeles, CA (US)

( * ) Notice: Subject to any disclaimer, the term of this patent is extended or adjusted under 35 U.S.C. 154(b) by 134 days.

(21) Appl. No.: 12/657,332

(22) Filed: Jan. 19, 2010

(65) Prior Publication Data

US 2011/0177871 A1 Jul. 21, 2011

(51) Int. Cl.
*A63J 5/02* (2006.01)
*A63J 21/00* (2006.01)

(52) U.S. Cl. ..... 472/68; 472/61; 446/47

(58) Field of Classification Search ..... 472/61, 472/68, 72, 80, 81; 446/46, 47; 362/184
See application file for complete search history.

(56) References Cited

U.S. PATENT DOCUMENTS

| | | | | | |
|---|---|---|---|---|---|
| 3,786,246 | A | * | 1/1974 | Johnson et al. | 446/47 |
| 3,812,614 | A | | 5/1974 | Harrington | |
| 4,301,616 | A | | 11/1981 | Gudgel | |
| 4,435,917 | A | * | 3/1984 | Lee | 446/47 |
| 4,563,160 | A | | 1/1986 | Lee | |
| 4,802,875 | A | * | 2/1989 | Cunningham | 446/46 |
| 4,934,712 | A | | 6/1990 | Byrd | |
| 5,032,098 | A | * | 7/1991 | Balogh et al. | 446/47 |
| 5,319,531 | A | * | 6/1994 | Kutnyak | 362/184 |
| 2006/0160457 | A1 | | 7/2006 | Moore | |
| 2006/0166589 | A1 | | 7/2006 | Moore | |
| 2009/0176433 | A1 | | 7/2009 | Forti | |
| 2009/0176434 | A1 | | 7/2009 | Forti | |

FOREIGN PATENT DOCUMENTS

CN 2 376 977 Y 5/2000

OTHER PUBLICATIONS

William Mark, Mystery Lights UFO, found at http://www.x-zylo.com/index.php?option=com_content&view=category&layout=blog&id=35&Itemid=125, 2008.
William Mark, My Mystery UFO, found at http://www.amazon.com/William-Mark-UFO001-Mystery-Hovering/dp/B001BHLWT4, 2008.
Jim Pace, Alien Spinning Thing, found at http://madhattermagicshop.com/magicshop/product_info.php?products_id=3270, Jan. 28, 2006.
Bob Hummer, Whirling Card Trick, found at http://www.amazon.com/Hummers-Original-Whirling-Card-Trick/db/B000SVC2CK, published in 1950.
International Search Report and Written Opinion of the ISA for PCT/US2011/021481, Apr. 21, 2011.
Laser Flite, found at http://www.thisismagic.com/html/laser_flite.html, published in 2005.

* cited by examiner

*Primary Examiner* — Kien Nguyen
(74) *Attorney, Agent, or Firm* — Marcus Risso; Risso & Associates

(57) ABSTRACT

Described is a levitating disk for performing illusions of levitation. The disk includes a disk-shaped housing, with a circuit board, microprocessor, and batteries encased within the housing. A series of LEDs are connected with the housing and are activated via a centrifugal force switch. The circuit board and batteries are positioned within the housing such that they distribute the weight evenly from a central axis toward the periphery of the housing. A micro-thread is included for attaching with the disk. Thus, in operation, a user can hang the disk with the micro-thread and spin the disk about the central axis to cause the lights to illuminate and cause the disk to appear as if it is levitating.

18 Claims, 9 Drawing Sheets

LEVITATING DISK

BACKGROUND OF THE INVENTION (1) Field of Invention

The present invention relates to props and gimmicks used in the field of magic to create a variety of illusions and, more particularly, to a disk with distributed weights to provide an illusion of levitation.

(2) Description of Related Art

The present invention relates to props and gimmicks used in the field of magic. More specifically, the present invention is related to a levitating object. The illusion of levitation is often accomplished using what is referred to as an invisible thread or micro thread. The micro thread is a super thin thread that is not commonly seen with the naked eye, which allows a magician to suspend an item from the thread to provide the illusion of levitation.

Using invisible thread, some magicians have been able to perform a "Flying Card" trick, in which they spin a suspended card. The "Flying Card" trick was originally created by Bob Hummer in the 1950's. This trick is difficult to accomplish because it requires a magician to spin a lightweight card with little balance.

Another magician, Jim Pace, created an improvement upon the original Flying Card trick in which he included LED lights on the edges of the card, with a battery in the center. In order to operate the LED's, the product requires a user to manually trigger the battery. Again, because the card is not round, it is difficult to spin. Finally, because the battery is positioned in the center of the card and not on the sides, the product can come off axis easily, which results in the card losing balance and its spin.

Thus, a continuing need exists for a levitating item that can be spun easily, that allows for easy actuation of LED's, and that is stable when spinning to prevent the item from losing its balance.

SUMMARY OF INVENTION

While considering the failure of others to make and/or use all of the above factors/ingredients/steps/components in this technology space, the inventor unexpectedly realized that a levitating disk with evenly distributed batteries would enable the item to be spun easily while maintaining its spin axis. Thus, the present invention is a levitating disk.

The levitating disk includes a disk-shaped housing having a central axis, with a series of lights connected with the housing. A circuit board is attached with the housing and electrically connected with the lights. A power source is electrically connected with the circuit board to power the lights. Thus, a user can attach a micro-thread with the disk-shaped housing and spin the disk-shaped housing about the central axis to cause the lights to illuminate and cause the disk to appear as if it is levitating.

In another aspect, a micro-thread is included for connection with the disk-shaped housing. An adhesive substance is also included for adhering the micro-thread to the disk-shaped housing.

In yet another aspect, the lights are light emitting diodes (LEDs).

Additionally, the circuit board is positioned within the housing and includes a central portion and a plurality of arms that each project from the central portion to an arm end. The circuit board is formed to include three arms that are substantially equally-shaped with one another to cause the circuit board to be substantially equally weighted about the central portion. Further, the power source includes three batteries, wherein each arm end includes a battery attached thereto, thereby causing the levitating disk to be substantially equally weighted about the central axis.

In yet another aspect, a microprocessor is attached with the housing and electrically connected with the circuit board. The microprocessor is operable for causing the lights to illuminate in various changing patterns.

Additionally, a centrifugal force operated switch is electrically connected with the circuit board. The centrifugal force switch is operable for activating the lights upon rotation of the levitating disk. The microprocessor is further configured to cause the lights to turn off after the levitating disk ceases rotating for a predetermined amount of time.

Finally, as can be appreciated by one in the art, the present invention also comprises a method for forming and using the levitating disk described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to props and gimmicks used in the field of magic to create a variety of illusions and, more particularly, to a disk with distributed weights to provide an illusion of levitation. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
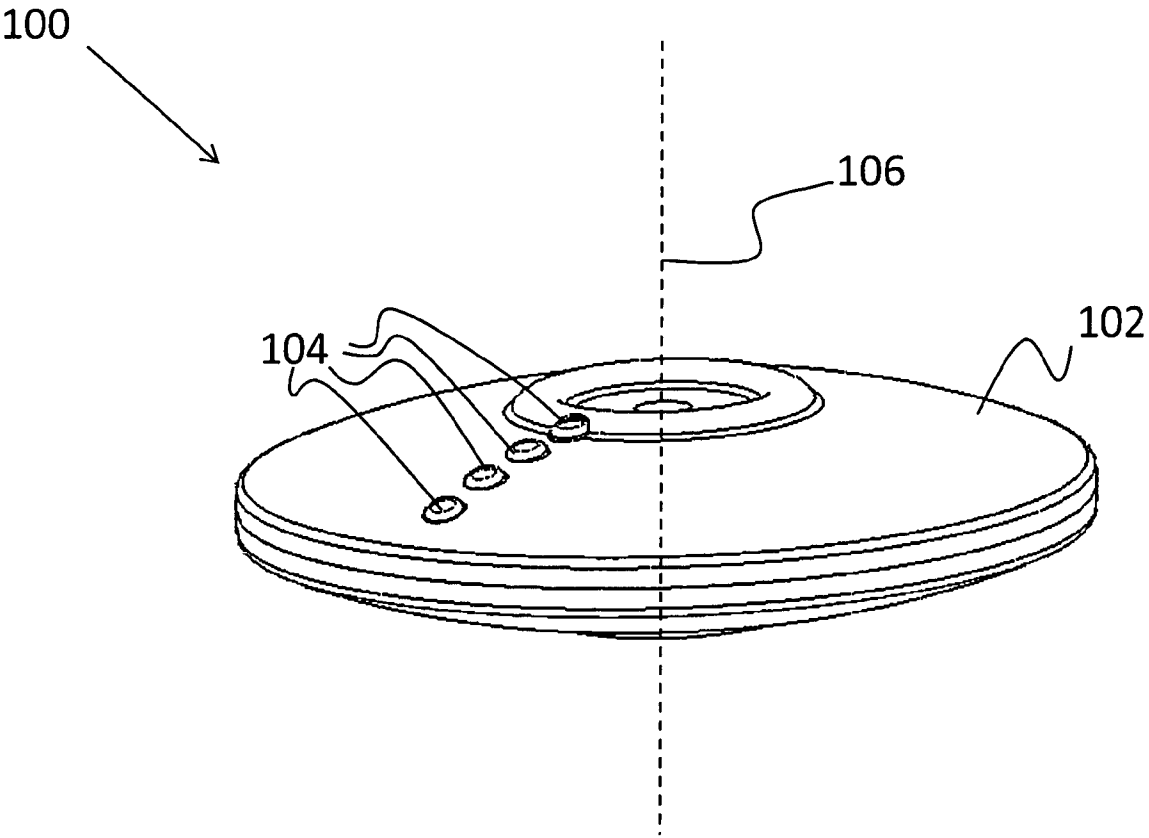
FIG. 1 is a perspective-view illustration of a levitating disk according to the present invention.

As shown in FIG. 1, the present invention is a levitating disk 100. More specifically, the preset invention is a rotatable disk that can used to provide the illusion of levitation. The levitating disk 100 includes a disk-shaped housing 102 with a series of lights 104 connected with the housing 102. The housing 102 can be formed into any suitable shape for rotation. As a non-limiting example, the housing 102 is formed to represent a UFO, such that the levitating disk 100 takes on the appearance of a miniature UFO. The housing 102 includes a central axis 106, around which the disk 100 can be rotated. The central axis 106 passes through the middle of the disk 100 to provide a central point of rotation.

Figure 2:
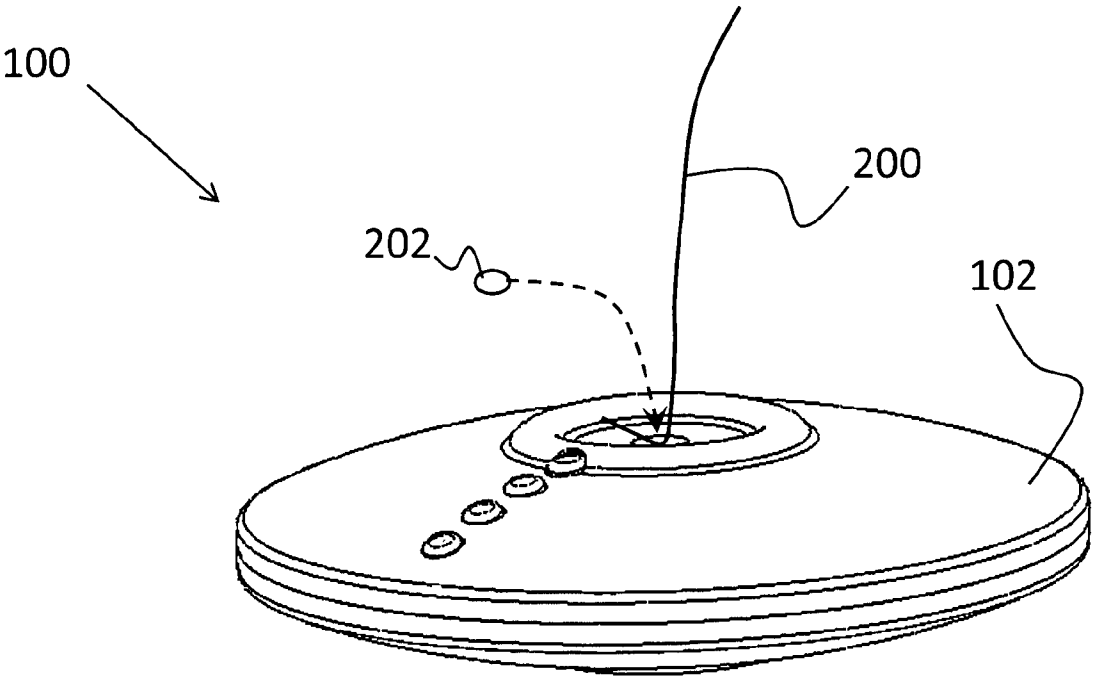
FIG. 2 is a perspective-view illustration of the levitating disk, depicting a micro-thread being attached with the disk.

As shown in FIG. 2, to spin the disk 100, the disk 100 needs to be suspended from something. Thus, the present invention also includes micro-thread 200 for connection with the disk-shaped housing 102. The micro-thread 200 is sometimes referred to as "invisible thread," and is any suitable thread or micro-filament that is very thin and difficult to see with the naked eye. Micro-thread can be made from nylon which has been separated into individual strands or, in some cases, a single strand of silk. A non-limiting example of a suitable micro-thread is "Invisible Thread," as sold by Yigal Mesika.

An adhesive substance 202 can be included for allowing a user to adhere the micro-thread 200 to the disk-shaped housing 102. The adhesive substance 202 is any suitable item that is operable for allowing a user to selectively adhere the micro-thread 200 to the disk-shaped housing 102, a non-limiting example of which includes wax. Thus, in operation, a user can use the wax to attach the micro-thread 200 to the disk 100.

Figure 3:
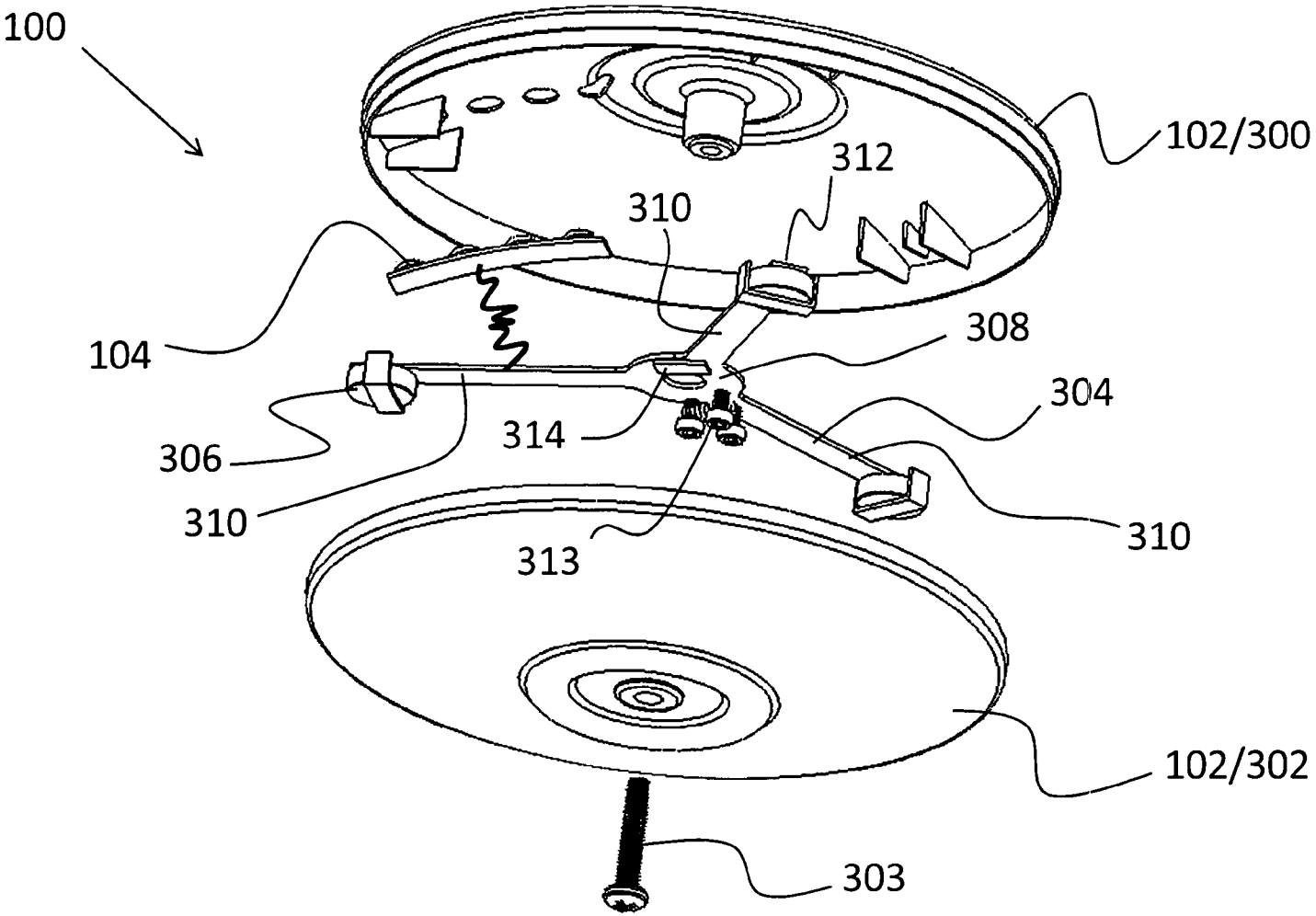
FIG. 3 is an exploded-view illustration of the levitating disk.

FIG. 3 provides an exploded view of the disk 100. As shown, the housing 102 includes a first half 300 and a second half 302, with the two halves being held together via a screw 303 (or any other suitable mechanism or device, such as snaps, clips, etc.). As can be understood by one skilled in the art, the housing 102 can be formed of any number of suitable components for containing and attaching the various items according to the present invention.

A circuit board 304 is attached with the housing 102 and electrically connected with the lights 104. The lights 104 are any suitable item(s) that are illuminable, a non-limiting example of which includes light emitting diodes (LEDs). To power the lights 104, a power source 306 is electrically connected with the circuit board 304 and/or the lights 104. The power source 306 is any suitable item capable of powering the lights 104, a non-limiting example of which includes a set of 3 volt lithium batteries.

As shown in FIG. 3, the circuit board 304 is positioned within the housing 102 and includes a central portion 308 and a plurality of arms 310 that each project from the central portion 308 to an arm end 312. The circuit board 304 includes any suitable number of arms 310 that project from the central portion 308, non-limiting examples of which include two, three, and four arms. As shown, the circuit board 304 includes three arms 310 that are substantially equally-shaped with one another and equally distributed about the central portion 308 to cause the circuit board 304 to be substantially equally weighted about the central portion 308 and central axis (depicted in FIG. 1).

Additionally, the disk 100 includes any suitable number of batteries as the power source 306. For example, the disk 100 includes three batteries. In this aspect, each arm end 312 includes a battery (i.e., power source 306) attached thereto. By attaching the batteries to the arm ends 312, the weight is evenly distributed around a periphery of the disk 100, which provides rotational stability with the disk 100 is rotated.

The disk 100 can include any suitable switching mechanism to activate the lights 104. For example, a slide switch can be included to provide electricity to the lights 104 and thereby allow a user to manually actuate and de-actuate the lights 104.

Alternatively, a centrifugal force operated switch 313 can be electrically connected with the circuit board 304. The centrifugal force switch 313 is operable for activating the lights 104 upon rotation of the levitating disk 104. For example, the centrifugal force switch 313 includes a spring with a pin rising from the circuit board 304. When the disk 100 is rotated, the centrifugal force exerted on the spring causes the spring to touch the pin and turn the lights 104 on.

The disk 100 also includes a microprocessor 314 that is attached with the housing 102 (via the circuit board 304 or any other suitable connection) and electrically connected with the circuit board 304. The microprocessor 314 is operable for causing the lights 104 to illuminate in various changing patterns. For example, the LED's will blink to create different patterns (e.g., thirty different patterns). The microprocessor 314 is also configured to cause the lights 104 to turn off after the levitating disk 100 ceases rotating for a predetermined amount of time (e.g., after one second).

As illustrated, the microprocessor 314 is attached with the circuit board 304 at the central portion 308 to reduce its effect on the rotational stability of the disk 100. As described above and illustrated in the figures, the weighting of the disk 100 is important to maintain rotational stability. This is further illustrated by the position of the three arms 310 with the batteries positioned at the arm ends 312. In other configurations, such as a circuit board 304 formed as a single strip (i.e., two arms projecting from the central portion 312), a battery would be positioned at each of the two arm ends 312, with the microprocessor 314 positioned in the central portion 308. Again, this provides rotational stability to the disk by distributing the weight evenly across the width of the disk 100 and, desirably, toward the periphery of the disk. By distributing the weight toward the periphery, the disk 100, when rotated, maintains rotational momentum, similar to a flywheel or gyroscope.

Figure 4:
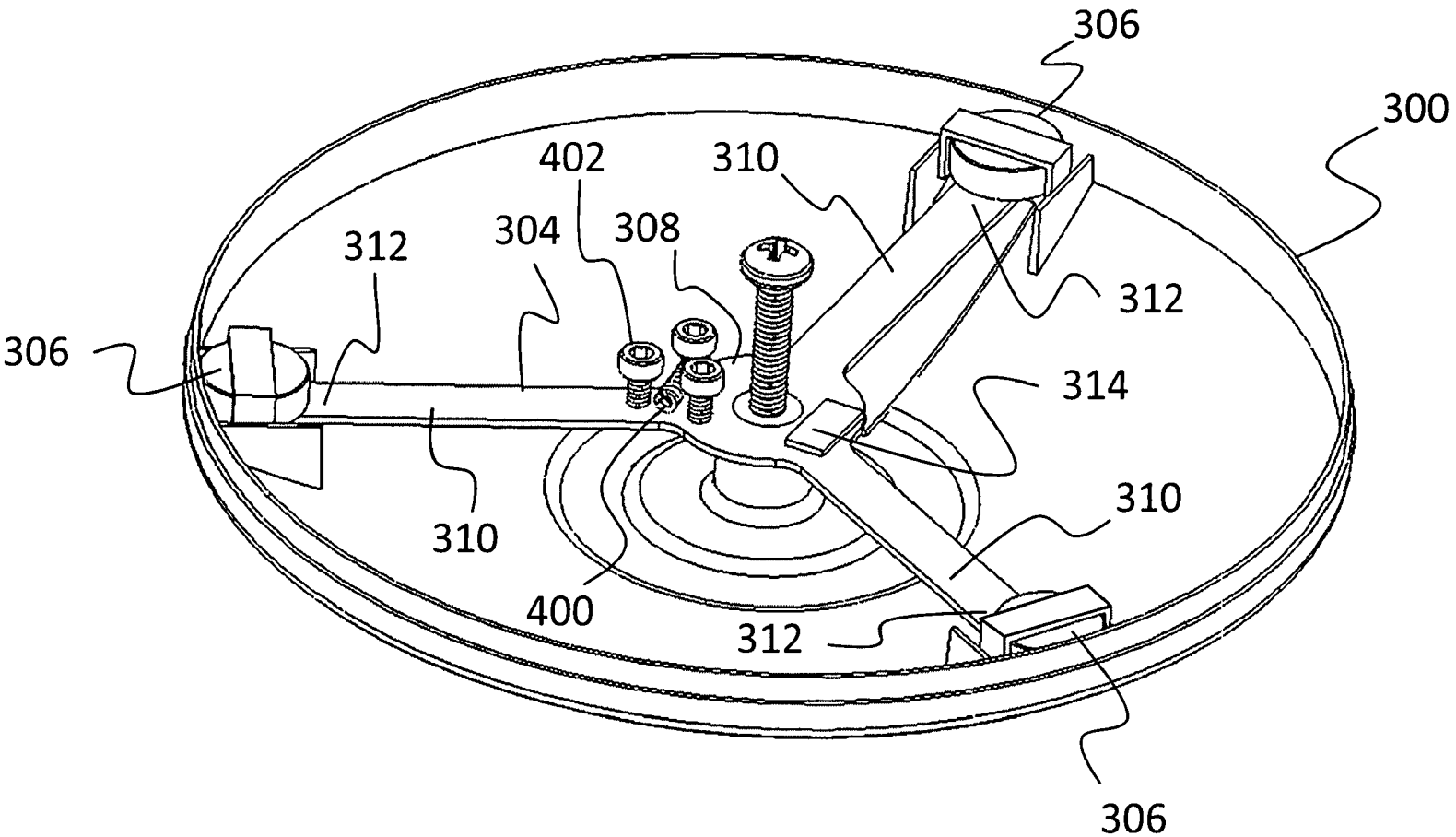
FIG. 4 is an internal-view illustration of the levitating disk.

FIG. 4 provides an illustration depicting the first half 300 of the disk and the internal components. As shown, the circuit board 304 includes three arms 310 that project from and are evenly distributed about the central portion 308. Also, the microprocessor 314 is attached near (or directly onto) the central portion 308. Additionally, the centrifugal force switch is depicted, including its spring 400 and pin 402 that rises from the circuit board 304. Finally, the batteries (i.e., power source 306) are illustrated as attached with the arm ends 312 of each arm.

Figure 5:
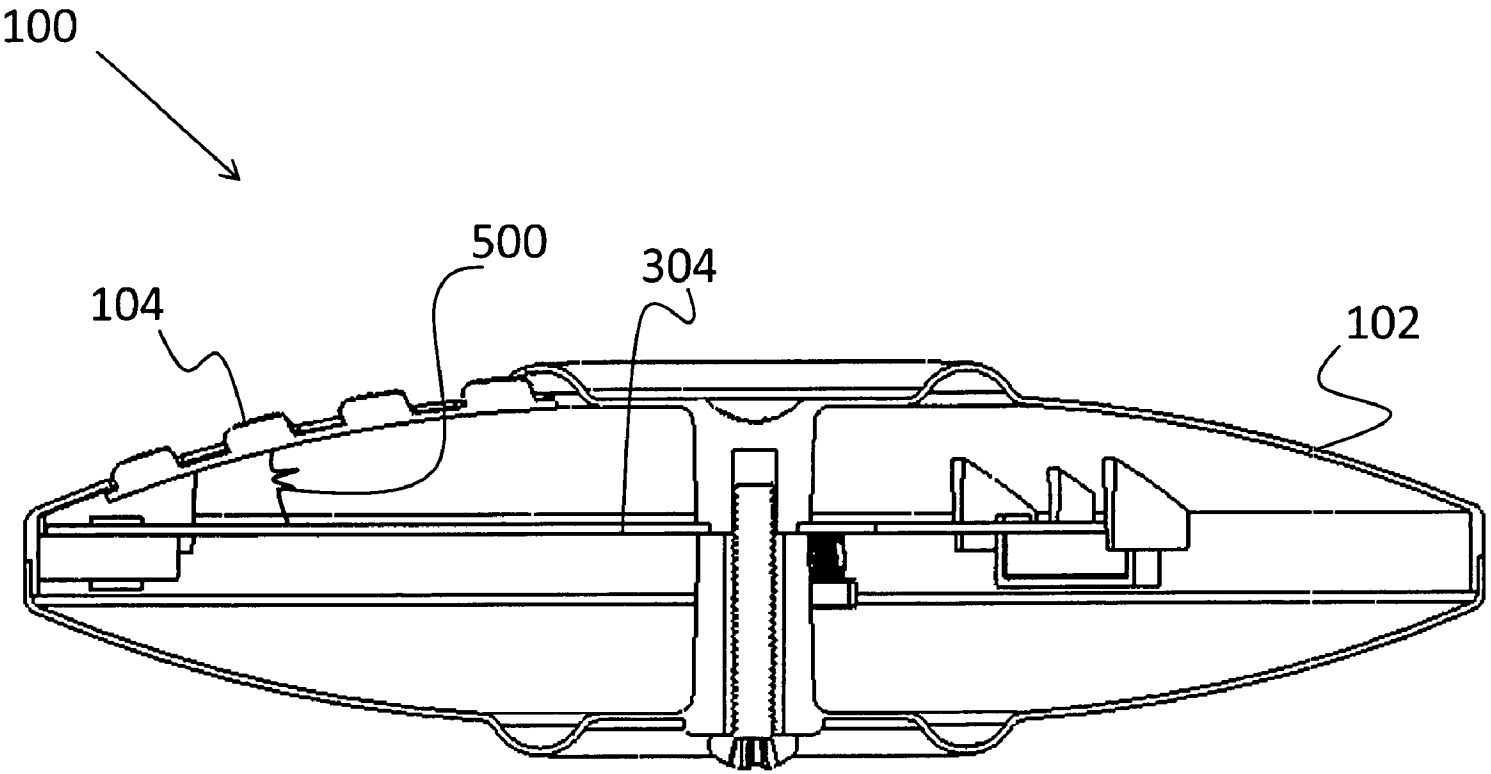
FIG. 5 is a cross-sectional, side-view illustration of the levitating disk.
Figure 6:
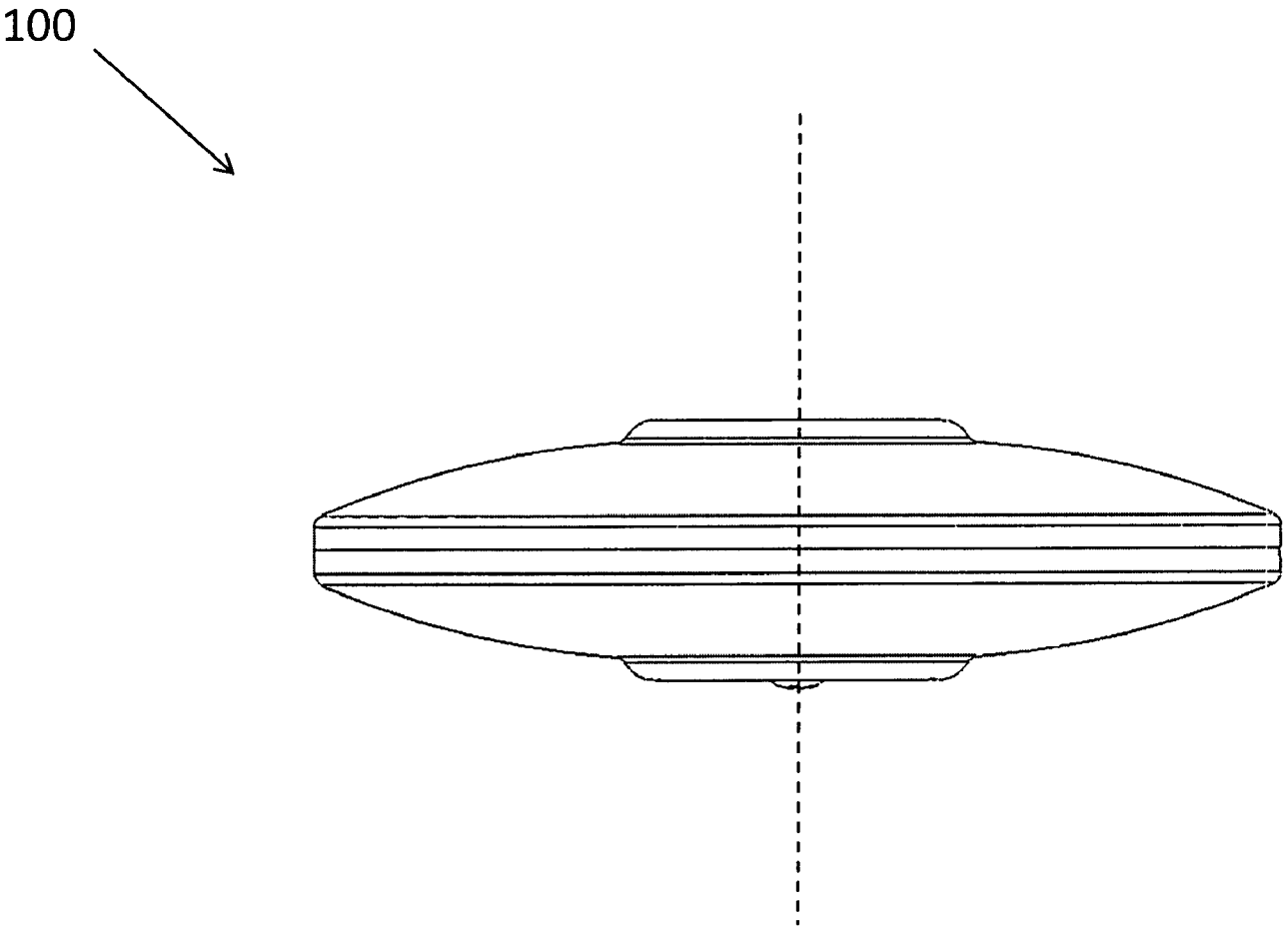
FIG. 6 is a rear-view illustration of the levitating disk.
Figure 7:
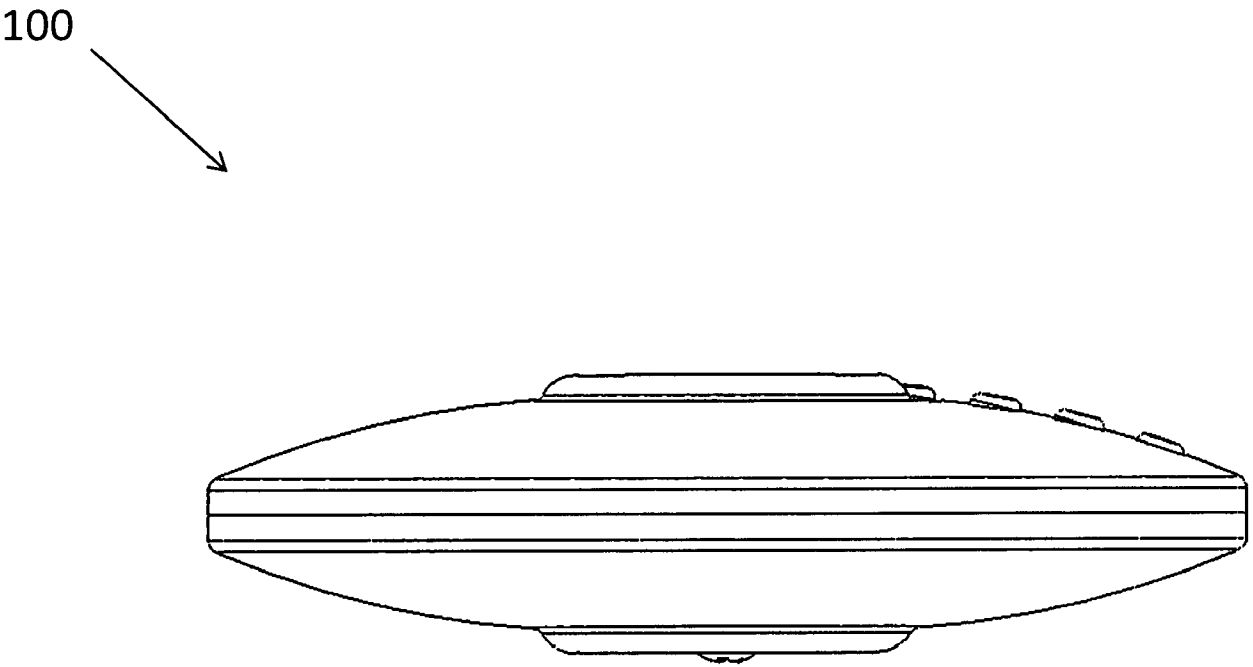
FIG. 7 is a right, side-view illustration of the levitating disk.
Figure 8:
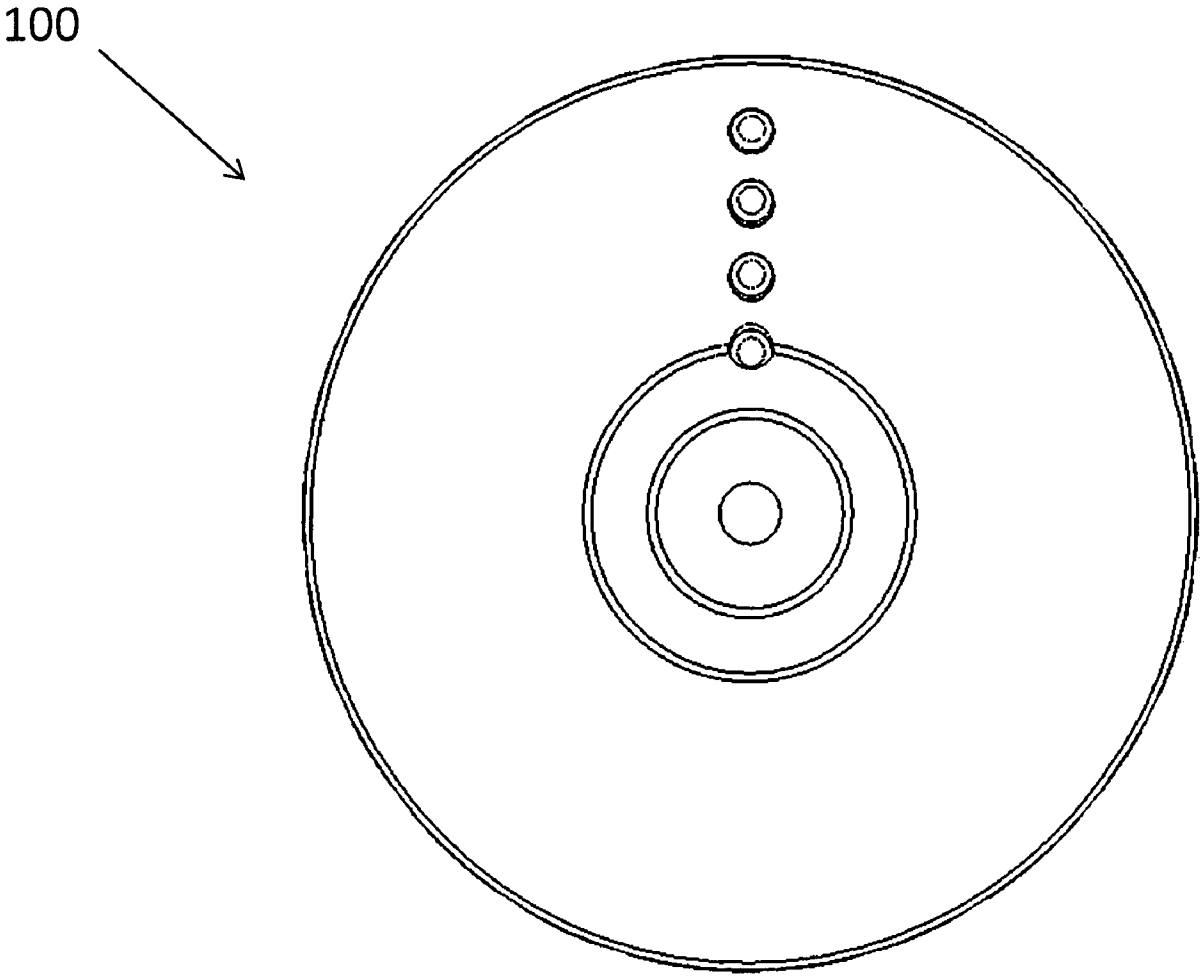
FIG. 8 is a top-view illustration of the levitating disk.
Figure 9:
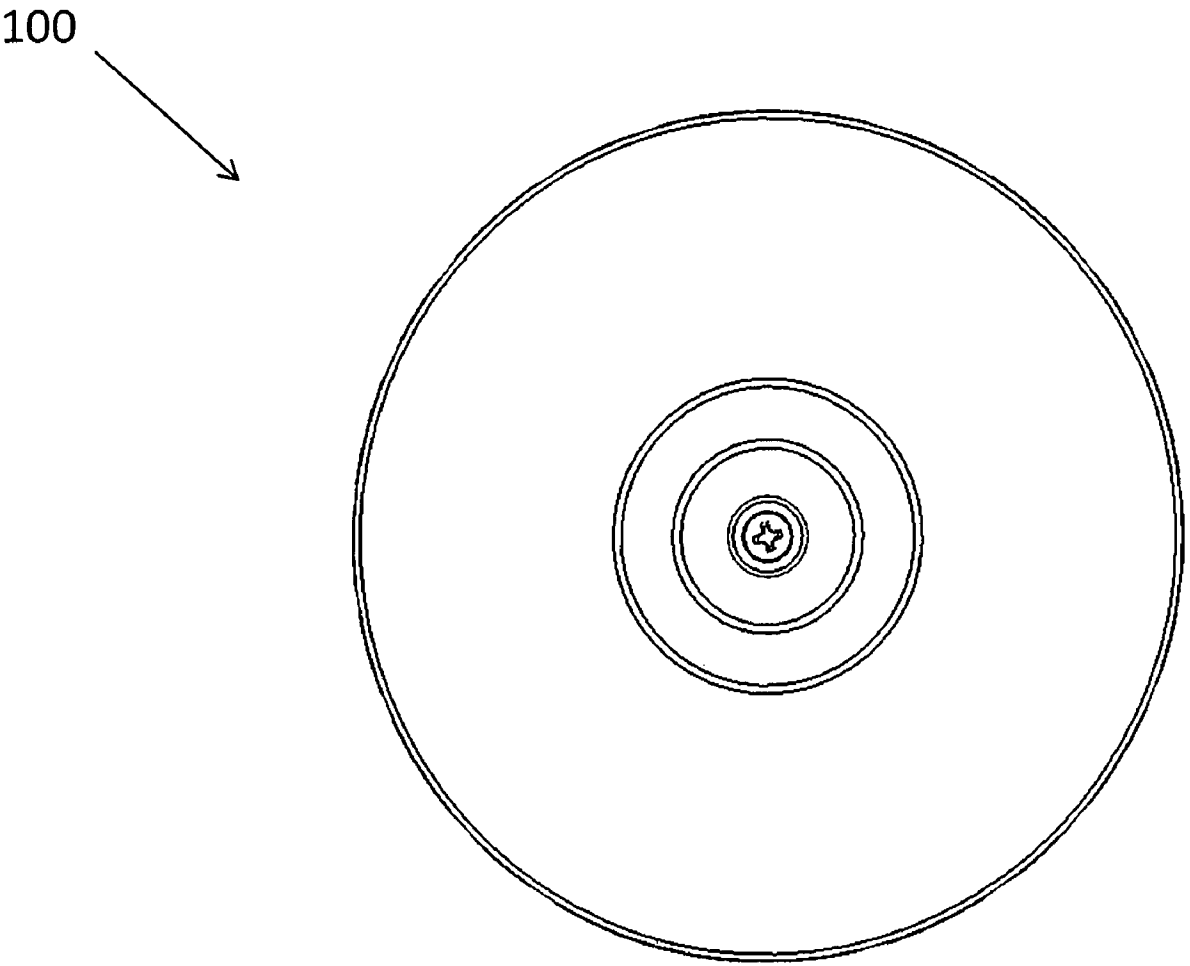
FIG. 9 is a bottom-view illustration of the levitating disk.

For further understanding, FIG. 5 provides a cross-sectional, side-view illustration of the disk 100. As shown, the circuit board 304 is encased within the housing 102, with the lights 104 being electrically connected 500 (via wiring, circuitry, or any other suitable electrical connection) with the circuit board 304. Additionally, FIGS. 6, 7, 8, and 9 depict rear, right, top, and bottom-views, respectively, of the disk 100.

Thus, as can be appreciated by one skilled in the art, the construction and weighting of the levitating disk 100 provides for an item that, when spun, includes rotational stability as it spins about the central axis. This is important when performing levitation illusions. An example of such an illusion would be to attach micro-thread to the housing using the adhesive substance (as described above). The other end of the micro-thread can be wrapped around and taped to a user's ear, causing the levitating disk 100 to hang from the user's ear. Once hanging, the levitating disk 100 can be spun, creating the illusion that the disk 100 is floating. Because the micro-thread is difficult to see, a user can "float" the disk 100 from one hand to the other by hooking a thumb around the thread and guiding the disk 100 as desired. This illusion can be enhanced by throwing the disk 100 around the user's body, which, due to its rotational momentum and being anchored to the user's body, will spin around the user.

What is claimed is:

1. A levitating disk, comprising;

a disk-shaped housing having a central axis;

a series of lights connected with the housing;

a circuit board attached with the housing and electrically connected with the lights;

a power source electrically connected with the circuit board to power the lights, whereby a user can attach a micro-thread with the disk-shaped housing and spin the disk-shaped housing about the central axis to cause the lights to illuminate and cause the disk to appear as if it is levitating; and an invisible thread for connection with the disk-shaped housing.

2. The levitating disk as set forth in claim 1, further comprising an adhesive substance for adhering the invisible thread to the disk-shaped housing.

3. The levitating disk as set forth in claim 2, wherein the lights are light emitting diodes (LEDs).

4. The levitating disk as set forth in claim 3, wherein the circuit board is positioned within the housing and includes a central portion and a plurality of arms that each project from the central portion to an arm end.

5. The levitating disk as set forth in claim 4, wherein the circuit board is formed to include three arms that are substantially equally-shaped with one another to cause the circuit board to be substantially equally weighted about the central portion.

6. The levitating disk as set forth in claim 5, wherein the power source includes three batteries, wherein each arm end includes a battery attached thereto, thereby causing the levitating disk to be substantially equally weighted about the central axis.

7. The levitating disk as set forth in claim 6, further comprising a microprocessor attached with the housing and electrically connected with the circuit board, the microprocessor being operable for causing the lights to illuminate in various changing patterns.

8. The levitating disk as set forth in claim 7, further comprising a centrifugal force operated switch electrically connected with the circuit board, the centrifugal force switch being operable for activating the lights upon rotation of the levitating disk.

9. The levitating disk as set forth in claim 8, wherein the microprocessor is further configured to cause the lights to turn off after the levitating disk ceases rotating for a predetermined amount of time.

10. The levitating disk as set forth in claim 1, wherein the circuit board is positioned within the housing and includes a central portion and a plurality of arms that each project from the central portion to an arm end.

11. The levitating disk as set forth in claim 10, wherein the circuit board is formed to include three arms that are substantially equally-shaped with one another to cause the circuit board to be substantially equally weighted about the central portion.

12. The levitating disk as set forth in claim 10, wherein the power source includes three batteries, wherein each arm end includes a battery attached thereto, thereby causing the levitating disk to be substantially equally weighted about the central axis.

13. The levitating disk as set forth in claim 1, further comprising a microprocessor attached with the housing and electrically connected with the circuit board, the microprocessor being operable for causing the lights to illuminate in various changing patterns.

14. The levitating disk as set forth in claim 13, wherein the microprocessor is further configured to cause the lights to turn off after the levitating disk ceases rotating for a predetermined amount of time.

15. The levitating disk as set forth in claim 1, further comprising a centrifugal force operated switch electrically connected with the circuit board, the centrifugal force switch being operable for activating the lights upon rotation of the levitating disk.

16. The levitating disk as set forth in claim 1, wherein the lights are light emitting diodes (LEDs).

17. The levitating disk as set forth in claim 1, wherein the power source is attached with the levitating disk such that it is positioned off of the central axis to distribute weight toward a periphery of the disk-shaped housing as the disk-shaped housing is rotated.

18. The levitating disk as set forth in claim 1, wherein the power source includes a plurality of batteries that are positioned off of the central axis and substantially equally positioned around the central axis, thereby causing the levitating disk to be substantially equally weighted around the central axis.

* * * * *